US006161529A

United States Patent [19]

Burgess

[11] Patent Number: 6,161,529

[45] Date of Patent: Dec. 19, 2000

[54] FILTER ASSEMBLY WITH SUMP AND CHECK VALVE

[75] Inventor: Stephen F. Burgess, Escalon, Calif.

[73] Assignee: Parker-Hannifin Corporation, Cleveland, Ohio

[21] Appl. No.: 09/329,773

[22] Filed: Jun. 10, 1999

[51] Int. Cl.[7] ..... F02B 25/06

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 3,834,365 | 9/1974 | Ussery | 123/573 |
| 4,370,971 | 2/1983 | Bush | 123/573 |
| 4,409,950 | 10/1983 | Goldberg | 123/573 |
| 4,580,543 | 4/1986 | Aoki | 123/573 |
| 5,027,784 | 7/1991 | Osawa et al. | 123/572 |
| 5,201,301 | 4/1993 | Re | 123/573 |
| 5,564,401 | 10/1996 | Dickson . | |

*Primary Examiner*—Marguerite McMahon

[57] ABSTRACT

A closed crankcase emission control assembly for an internal combustion engine includes a replaceable filter element having a ring of filter media; a first annular end cap sealed to one end of the media ring; a sump container defined by a second annular end cap sealed to the other end of the media ring and a cup-shaped valve pan fixed to the second end cap; and a check valve in the valve pan to block blow-by gas flow directly into the filter element during engine operation, and to allow collected oil flow out of the sump container during engine idle or shut-down. The filter element of the present invention is located in a filter housing including an inlet port to receive blow-by gasses from the engine crankcase, and an outlet port to provide the substantially oil and particulate free gasses to an induction system (e.g. a turbocharger) and back to the engine crankcase. A pressure control assembly can be provided with the emission control assembly to maintain acceptable levels of crankcase pressure.

39 Claims, 6 Drawing Sheets

FILTER ASSEMBLY WITH SUMP AND CHECK VALVE

FIELD OF THE INVENTION

The present invention is directed to a filter assembly for a crankcase emission control system. The crankcase emission control system is useful for a heavy internal combustion engine, such as a diesel engine.

BACKGROUND OF THE INVENTION

Emission controls for internal combustion engines have become increasingly important as concerns over environmental damage and pollution have risen prompting legislators to pass more stringent emission controls. Much progress has been made in improving exhaust emission controls. However, crankcase emission controls have been largely neglected.

Crankcase emissions result from gas escaping past piston rings of an internal combustion engine and entering the crankcase due to high pressure in the cylinders during compression and combustion. As the blow-by gas passes through the crankcase and out the breather, it becomes contaminated with oil mist. In addition to the oil mist, crankcase emissions also contain wear particles and air/fuel emissions. Only a small number of heavy diesel engines have crankcase emission controls. Some of current production diesel engines discharge these crankcase emissions to the atmosphere through a draft tube or similar breather vent contributing to air pollution. Some of the crankcase emissions are drawn into the engine intake system causing internal engine contamination and loss of efficiency.

The released oily crankcase emissions coat engine sites, such as the inside of engine compartments or chambers, fouling expensive components and increasing costs, such as clean-up, maintenance and repair costs. As the oily residue builds up on critical engine components, such as radiator cores, turbocharger blades, intercoolers and air filters, it becomes a "magnet" for dust, grit and other airborne contaminants. Particulates in the contaminated oily crankcase emissions include particles and aerosols. The accumulation of the particulates on these components reduces efficiency, performance and reliability of the engine.

In addition to increasing engine performance and decreasing maintenance intervals and site/critical engine component contamination, crankcase emission controls are becoming increasingly important in reducing air pollution. Engine emissions include both crankcase and exhaust emissions. Because of reductions in exhaust emissions, the percentage of the total engine emissions due to crankcase emissions has risen. Therefore, reducing crankcase emissions provides a greater environmental impact with engines having low exhaust emissions.

Furthermore, most of the crankcase particulate emissions (CPE) are soluble hydrocarbons, as opposed to the exhaust emissions that are mainly insoluble organics. The crankcase particulate emissions are oil related, with ethylene (C.sub.2 H.sub.4) being predominant. Therefore, separating the oil and returning the cleaned oil free crankcase emissions to the engine inlet for combustion increases engine efficiency.

Crankcase flow and particulate emissions increase dramatically with engine life and operating time. Thus, the environmental impact and engine efficiency from recycling the crankcase emissions increase with operating time. For example, in buses having diesel engines, the crankcase particulate emissions represent as much as 50% of the total exhaust particulate emissions.

Crankcase emission control systems filter the crankcase particulate emissions and separate the oil mist from the crankcase fumes. The separated oil is collected for periodic disposal or return to the crankcase.

Crankcase emission control systems may be "open" or "closed" systems. In open crankcase emission control systems, the cleaned gases are vented to the atmosphere. Although open systems have been acceptable in many markets, they pollute the air by venting emission to the atmosphere and can suffer from low efficiency. Closed systems eliminate crankcase emissions to the atmosphere, meet strict environmental regulations, and eliminate site and external critical component contamination.

In closed crankcase emission control systems, the cleaned gases are returned to the engine combustion inlet. One of the first closed systems by Diesel Research, Inc. of Hampton Bays, N.Y., included a two-component crankcase pressure regulator and a separate filter.

Closed crankcase emission control systems require a high efficiency filter and crankcase pressure regulator. The high efficiency filter is required to filter out small sized particles to prevent contamination of turbochargers, aftercooler, and internal engine components. The pressure regulator maintains acceptable levels of crankcase pressure over a wide range of crankcase gas flow and inlet restrictions.

In a closed system, the crankcase breather is connected to the inlet of the closed crankcase emission control system. The outlet of the closed crankcase emission control system is connected to the engine air inlet, where the filtered blow-by gas is recycled through the combustion process.

A recent improvement to closed crankcase emission control systems is shown in U.S. Pat. No. 5,564,401, which is also owned by Diesel Research, Inc. In this system, a pressure control assembly and a filter are integrated into a single compact unit. The pressure control assembly is located in a housing body and is configured to regulate pressure through the system as well as agglomerate particles suspended in the blow-by gasses. Inlet and outlet ports direct the blow-by gasses into and out of the housing body from the engine block. A filter housing enclosing a replaceable filter is removably attached to the housing body to separate any remaining oil from the blow-by gasses. The filter element can be easily removed from the filter housing for replacement, after removing the filter housing from the housing body. The separated oil drains down and collects in a reservoir at the bottom of the filter housing. An oil drain check valve is located in the bottom wall of the filter housing, and includes a free-floating (one-way) valve. The check valve is connected through a separate return line to the oil pan or engine block to return the collected oil to the engine.

The system shown in U.S. Pat. No. 5,564,401 provides a closed crankcase emission control systems that is compact and combines various components into a single integrated unit, is efficient, and is simple and inexpensive to manufacture.

Nevertheless, it is believed there are certain disadvantages to the '401 emission control system. The oil collecting on the inside surface of the media ring drains down onto the lower end cap, and then must make its way radially outward through the media, before it then drips down into the oil reservoir area for return to the engine. The return path through the media can be obstructed as the filter element becomes spent, which results in the oil being retained in the element and thereby less oil being returned to the engine crankcase. Spillage of the oil can occur during an element change, which can create handling issues.

The filter element in the '401 system may also be removed and replaced with less-preferred elements. This is because the filter element in the '401 patent comprises a simple, ring-shaped media with a pair of end caps, which is available from a number of sources. However, less-preferred elements can suffer from poor performance, incorrect sizing, inappropriate material, etc. Replacing an approved filter element with a less-preferred element can reduce the oil-separating ability of the filter and, in extreme circumstances, possibly harm the engine.

The check valve in the housing for the '401 system can also become clogged and/or worn over time, and have to be removed and replaced. Since the check valve is part of the filter housing, this generally means replacement of the entire (relatively expensive) filter housing, and also keeping a separate maintenance schedule for the filter housing/check valve.

Still further, the return line for the oil is a separate component from the crankcase emission line from the engine. This requires separate plumbing between the engine and emission control system, and generally increases the material, installation and maintenance costs associated with the system.

While the system shown in the '401 patent has received considerable acceptance in the market as being a considerable improvement over previous systems, it is believed there is a demand in the industry for a further improvement, most notably an improved filter assembly for such a crankcase emission control system which overcomes the drawbacks noted above, and still provides a system that is compact and combines various components into a single integrated unit, is efficient, and is simple and inexpensive to manufacture.

SUMMARY OF THE PRESENT INVENTION

The present invention provides a novel and unique filter assembly for a crankcase emissions control assembly. Oil collected in the filter drains directly into a sump chamber (not through the filter media), and can be returned through a check valve to the engine. The oil drains back through the crankcase emissions line, which reduces the number of lines needed to and from the engine. The check valve is also integral with the filter element, and is thereby replaced at the same time the filter element is replaced. The replacement of the unique filter element can also be controlled through patent protection, which ensures that only filter elements meeting the proper standards of quality and performance are used in the assembly. The filter assembly is used in a emissions control assembly to provide a system that is compact and combines various components into a single integrated unit, is efficient, and is simple and inexpensive to manufacture.

According to the present invention, the filter assembly includes a replaceable crankcase filter element comprising a ring of filter media circumscribing a central cavity. The media ring has a first (upper) end and a second (lower) end. A first annular end cap is sealingly attached to the first end of the filter media ring, and has a central opening into the central cavity of the filter media ring. A second annular end cap is sealingly attached to the second end of the filter media ring. The second end cap also has a central opening into the central cavity of the filter media ring, and further includes a cylindrical portion toward the periphery of the second end cap extending downwardly away from the filter media ring. An annular, radially-outward directed catch is provided on the cylindrical portion of the second end cap.

A cup-shaped valve pan is fixed to the second end cap, and together with the second end cap, defines a sump container integral with the filter element. The valve pan has a cylindrical sidewall and an end wall. The cylindrical sidewall of the valve pan closely receives the cylindrical portion of the second end cap and includes an inwardly-directed, circumferentially-extending channel that receives the annular catch of the second end cap to fix the valve pan to the second end cap. Alternatively, the valve pan can be fixed to the second end cap by other appropriate means, such as with adhesive or sonic welding; or can be formed unitarily (in one piece) with the second end cap.

In any case, oil collecting on the media ring drains down through the central opening in the second end cap directly into the sump container. The oil does not have to pass through the media to get to the container. The valve pan includes a check valve which allows the collected oil to drain directly back to the engine through the crankcase emissions line. The check valve includes a T-shaped check valve member received in a central hole in the end wall of the valve pan, with the head of the valve member located exterior to the valve pan. An annular array of drain openings surround the central hole, and are covered by the head of the valve member when the head of the valve member is against the end wall of the valve pan.

The blow-by gasses from the crankcase emissions line force the valve member upwardly against the end wall of the valve pan during engine operation to prevent blow-by gasses from entering the sump container (and passing directly into the lower end of the filter element). When the engine is idle or non-operative, the collected oil forces the check valve member downwardly away from the end wall of the valve pan into an open position to allow the oil to drain through the flow openings back to the engine.

The filter assembly described above is located in a filter housing having inlet and outlet ports to separate contaminated oily gas, and filter any particulate matter in the gas. A pressure control system can also be provided with the emission control system to regulate pressure through the system.

The filter assembly also incorporates a separate primary breather filter to initially separate heavy oil droplets from the blow-by gasses prior to the gasses entering the pressure control assembly and the crankcase filter.

The filter assembly of the present invention thereby overcomes many of the drawbacks noted above, and still provides a system that is compact and combines various components into a single integrated unit, is efficient, and is simple and inexpensive to manufacture.

Further features of the present invention will become apparent to those skilled in the art upon reviewing the following specification and attached drawings.

DETAILED DESCRIPTION OF THE PREFERRED EMBODIMENT

Figure 1:
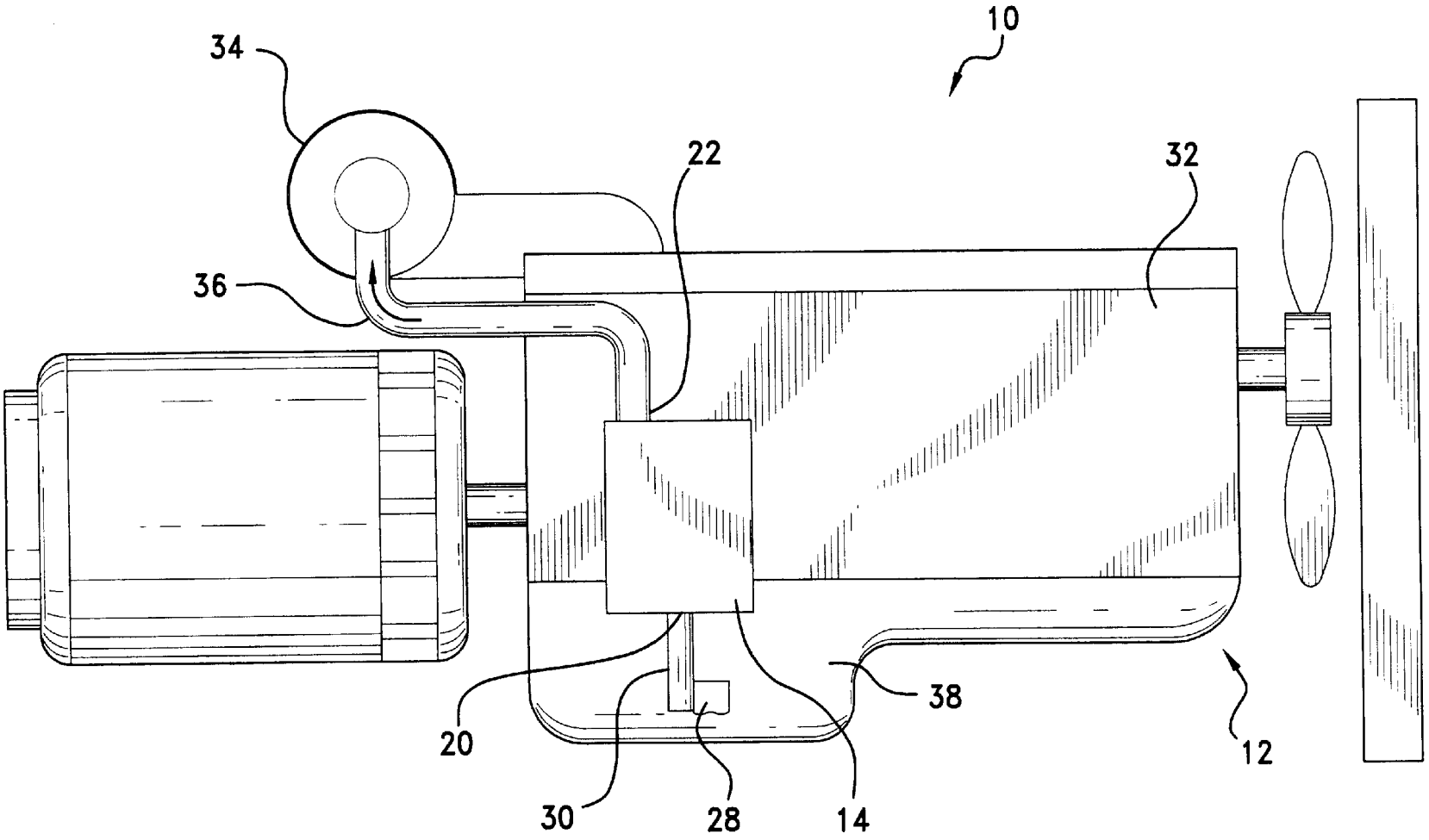
FIG. 1 is an illustration of an internal combustion engine having a closed crankcase emission control system according to the present invention.

Referring to the drawings, and initially to FIG. 1, a closed crankcase emission control system is indicated generally at 10. The system includes comprises an internal combustion engine, indicated generally at 12, and an integrated crankcase emission control assembly 14. The integrated crankcase emission control assembly 14 includes a filter and a pressure control assembly, as will be described below.

The crankcase emission control assembly 14 has a gas inlet 20 and a gas outlet 22. The gas inlet 20 is connected to the engine crankcase breather 28 via an inlet hose 30 and receives contaminated oily gas from the engine crankcase 32. The crankcase emission control assembly 14 separates the contaminated oily gas, agglomerates small particulates to form larger particulates, and filters the large particulates.

The cleaned crankcase emissions exit from the gas outlet 22 and enter the engine air intake 34 for combustion via an outlet hose 36. The separated oil is returned to the oil pan 38 through inlet hose 30.

Figure 2:
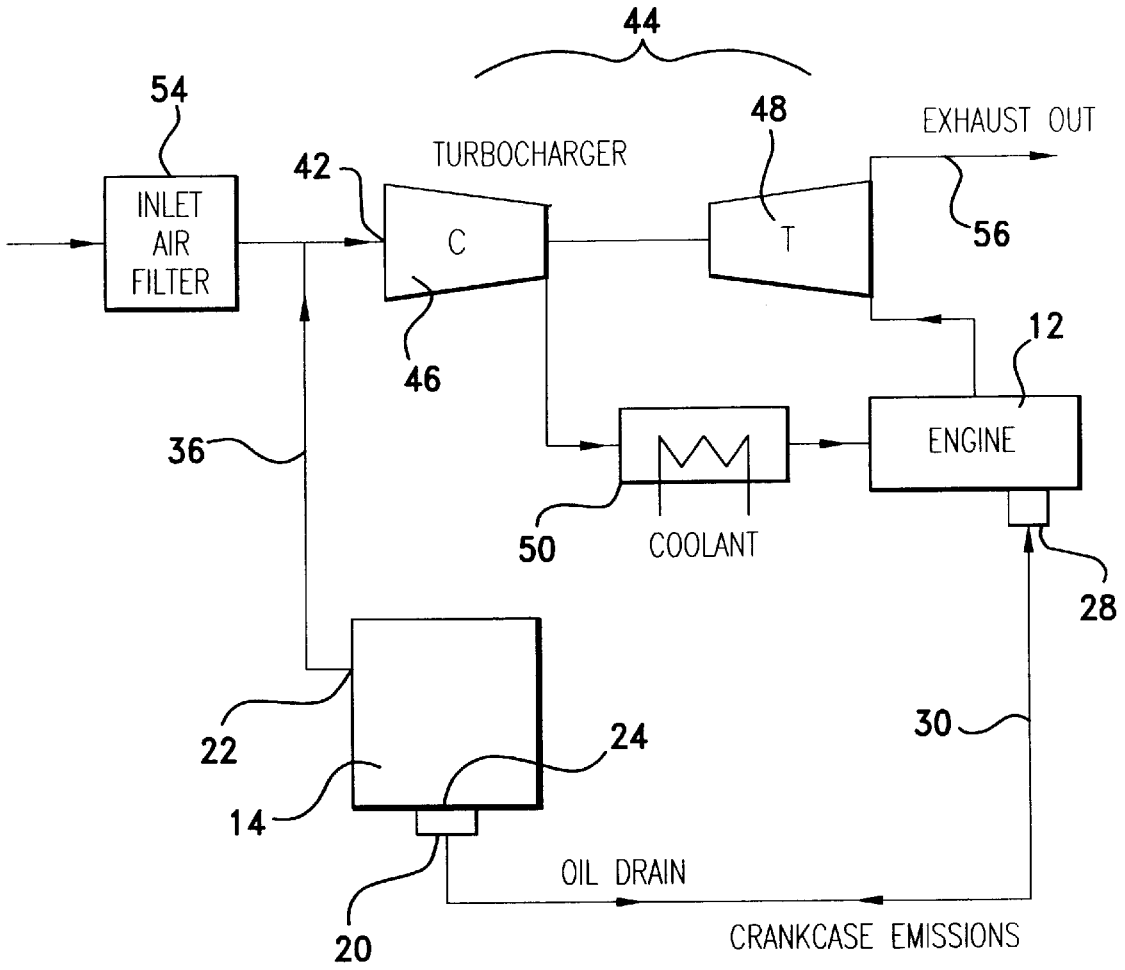
FIG. 2 is a block diagram representation of the closed crankcase emission control system shown in FIG. 1.

FIG. 2 is a block diagram representation of FIG. 1, wherein the cleaned crankcase emissions enter an induction system such as the air intake 42 of a turbocharger system, indicated generally at 44. The turbocharger system includes a compressor 46, a turbocharger 48, and an aftercooler 50. The engine also receives clean air through a silencer filter 54, while the exhaust manifold (not shown) of the engine and the turbocharger 48 are coupled to an exhaust line 56.

Figure 3:
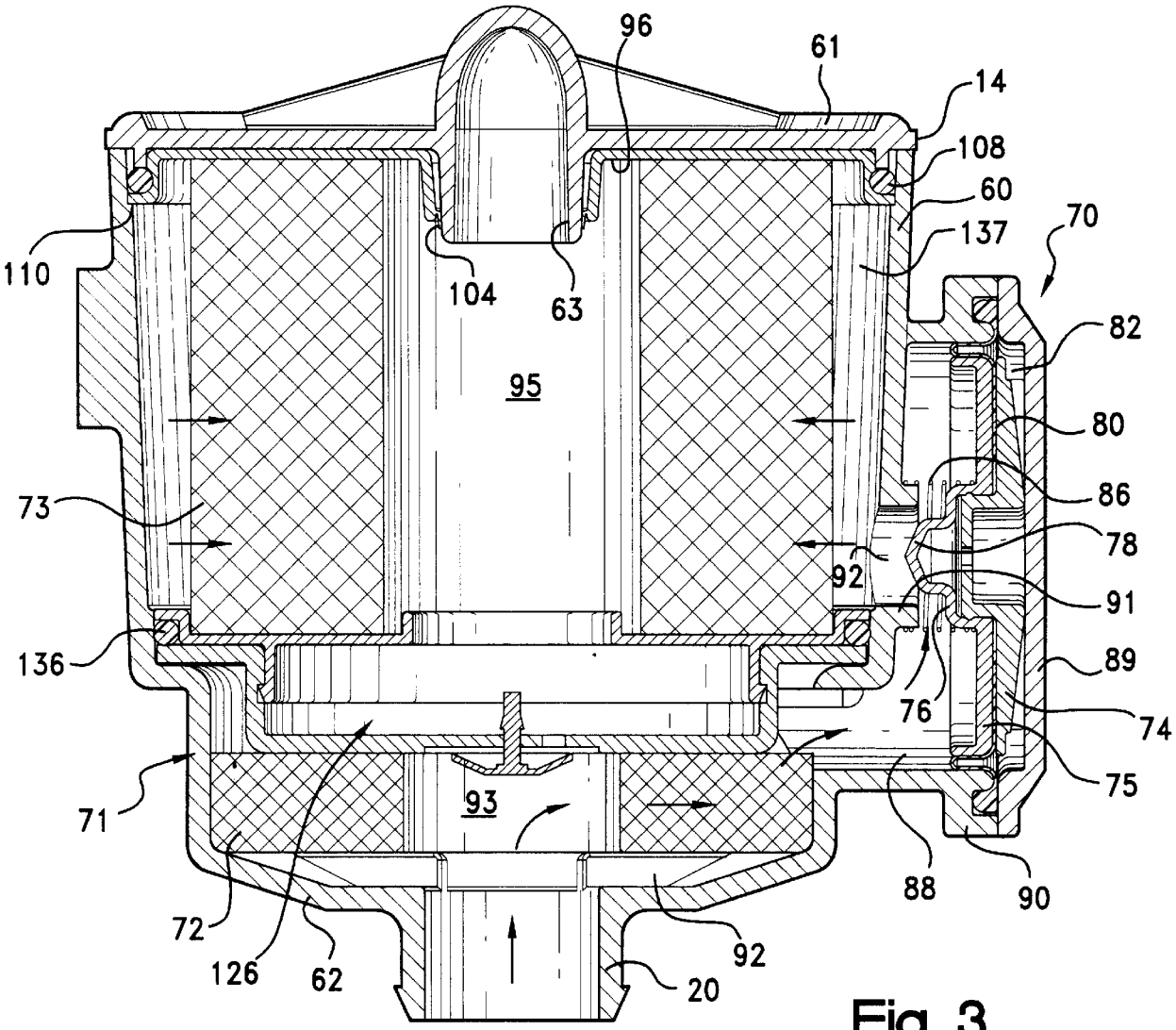
FIG. 3 is a cross-sectional side view of a closed crankcase emission control system with a filter assembly constructed according to the present invention.
Figure 4:
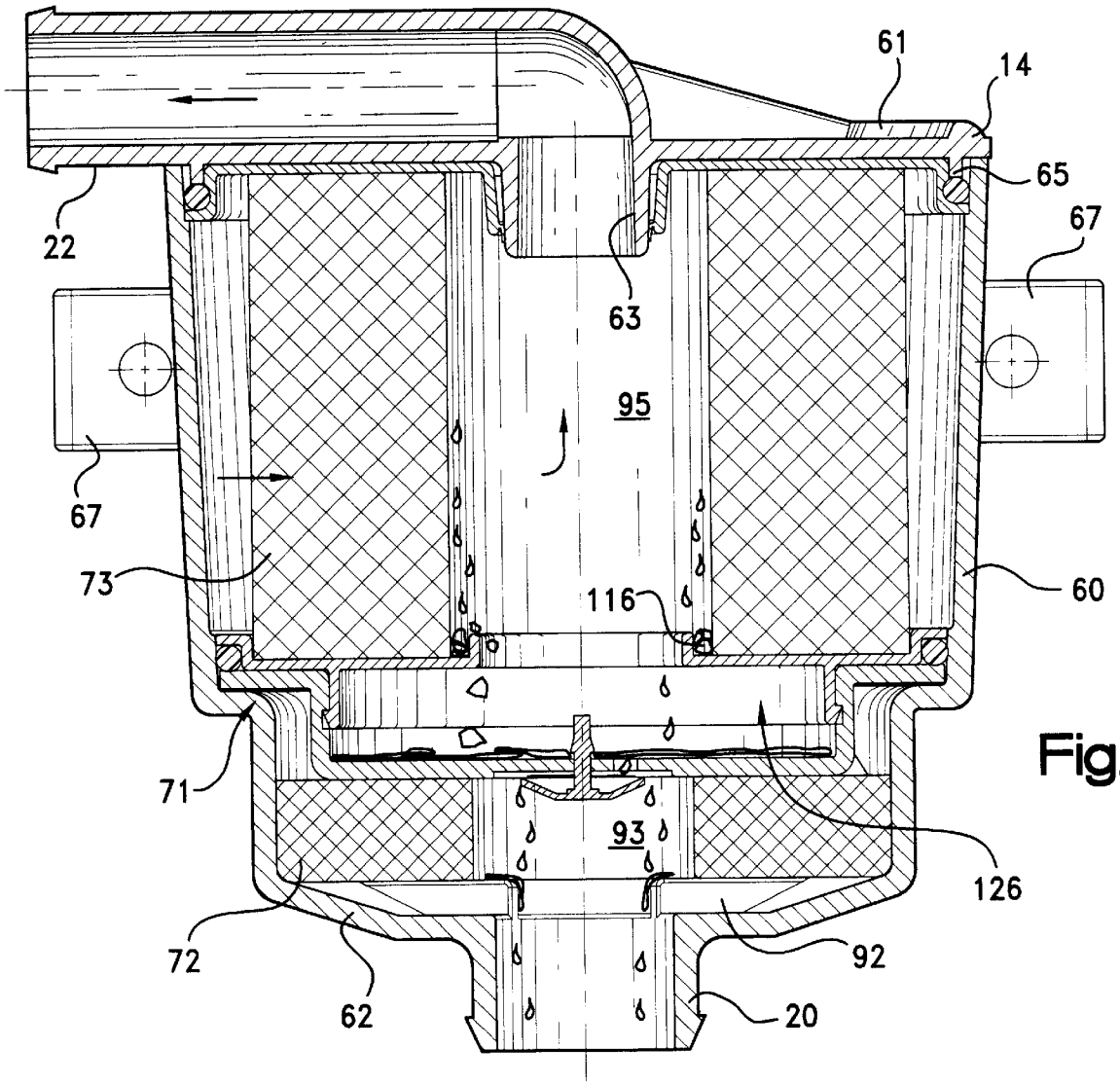
FIG. 4 is a cross-sectional side view similar to FIG. 3 but where the crankcase emission control system is rotated 90 degrees for clarity.

FIGS. 3 and 4 show a cross-section of the crankcase emission control assembly 14 for the engine. The crankcase emission control assembly 14 includes a housing including a cylindrical sidewall 60 and a removable cover 61. The gas inlet 20 is located in a bottom wall 62 of the sidewall 60, while the gas outlet 22 is located in cover 61. Gas outlet 22 includes a cylindrical sleeve 63 which extends inwardly into the crankcase emission control assembly 14. The gas inlet 20 and gas outlet 22 may have barbs to facilitate attachment of the appropriate inlet and outlet hoses.

Cover 61 is removably attached to sidewall 60 in an appropriate manner. For example, cover 61 may have a downwardly-extending cylindrical flange 65 with outwardly-directed threads, which mate with inwardly-directed threads at the upper end of housing 14. In this manner, the cover 61 can be easily screwed onto or off of the sidewall 60. The housing can include appropriate attachment flanges 67 to allow the crankcase emission control assembly to be mounted at an appropriate location on the engine.

The housing contains a pressure control assembly, indicated generally at 70 (FIG. 3), and a filter assembly, indicated generally at 71. Pressure control assembly 70 acts as a pressure regulator and an inertial separator and agglomerator for the blow-by gasses received from the engine. The filter assembly separates oil suspended in the blow-by gasses, and includes a primary breather filter 72 for separating heavy oil droplets before the blow-by gasses reach the pressure control assembly 70; and a crankcase filter 73 for separating any remaining smaller droplets after the gasses have passed through the pressure control assembly 70, as well as any particulate matter in the gasses.

The pressure control assembly 70 is mounted on the side of housing 14 and comprises a valve having a valve body 74 connected to a valve head 75. In turn, the valve head 75 is connected to a valve plug 76. A valve guide 78 is connected to the valve plug 76. An annular rolling diaphragm 80 is located circumferentially around the valve body 74. The diaphragm 80 separates the valve body 74 from an annular chamber 82 that is vented to the atmosphere. A coil spring 86 is located around the valve plug 76, between the valve body 74 and a lower surface of an annular inlet chamber 88. The valve body 74, valve head 75, valve plug 76, valve guide 78, diaphragm 80 and coil spring 86 are enclosed between a cover 89 and a cylindrical flange 90 formed in one piece with sidewall 60. Diaphragm 80 serves as a fluid seal between cover 89 and flange 90.

The inlet chamber 88 of the pressure control assembly 70 is fluidly connected to gas inlet 20 through breather filter 72. In addition, an opening of a cylindrical body channel 91 is located at the center of the inlet chamber 88. Body channel 91 defines an outlet passage 92 from the pressure control assembly to the crankcase filter 73, and consequently to gas outlet 22. The valve guide 78 is located within the body channel 91.

The body channel 91 has an outer end defining a valve seat opposite the valve plug 76. The valve seat of channel 91, combined with the valve plug 76 and valve head 74, define a variable orifice of an inertial separator and agglomerator. The valve plug 76 is moved toward and away from the valve seat of channel 91, depending upon the pressure received through the gas inlet 20. The pressure control assembly 70 keeps the pressure in the inlet chamber 88 and engine crankcase constant. Oil droplets also impinge upon valve plug 76, collect, and then drip down toward the bottom of the housing 14. Additional detail of the pressure control assembly can be found in U.S. Pat. No. 5,564,401, which is incorporated herein by reference.

The breather filter 72 of the filter assembly 71 comprises an annular filter media formed of appropriate material (e.g., steel mesh) that is supported on a series of radial fins or ridges 92 at the bottom end of the sidewall 60. The breather filter is typically fixed within the housing in an appropriate manner, and is typically not replaced, or at least not replaced at the intervals typically found with the crankcase filter 73. The breather filter has a central opening 93 allowing unobstructed access to gas inlet 20. Blow-by gasses entering gas inlet 20 initially pass radially outward through the breather filter 72, where heavy oil droplet are removed in the breather filter, collect, and then drain downwardly through gas inlet 20 back to the engine. The blow-by gasses then pass to inlet chamber 88 of pressure control assembly, and through the pressure control assembly to crankcase filter 73. As described above, additional oil suspended in the blow-by gasses collects on the valve plug 76, drips downwardly, and drains through the large mesh structure of filter breather 72, and then through gas inlet 20 back to the engine.

Figure 5:
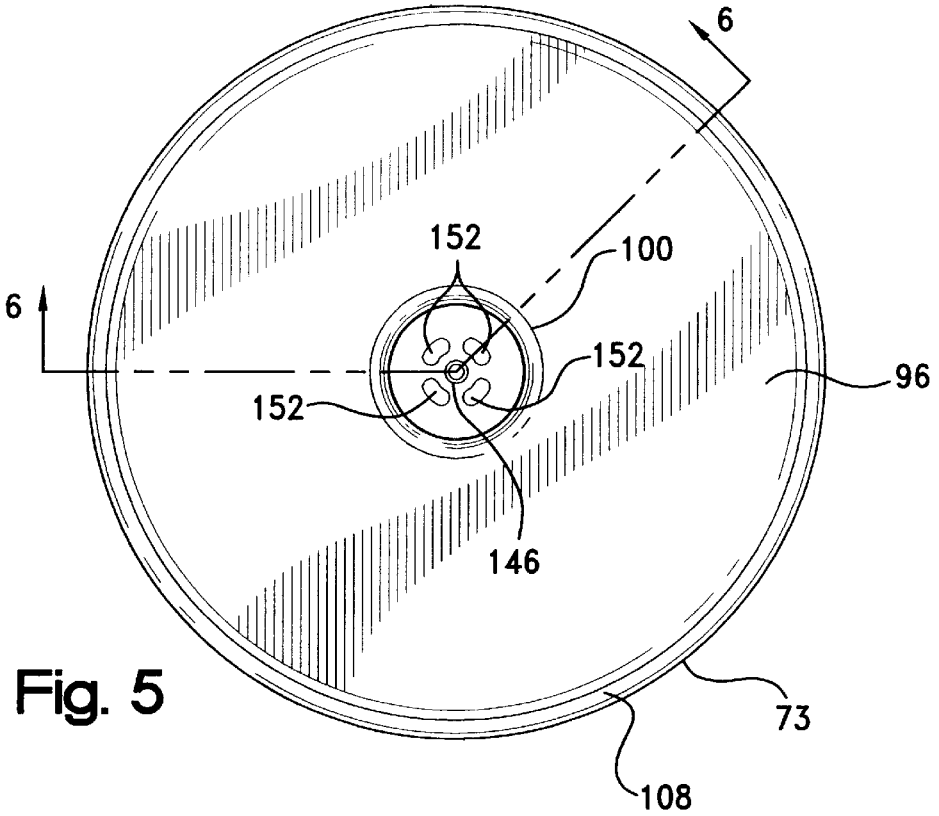
FIG. 5 is an end view of the filter element for the crankcase emission control system of FIG. 3.
Figure 6:
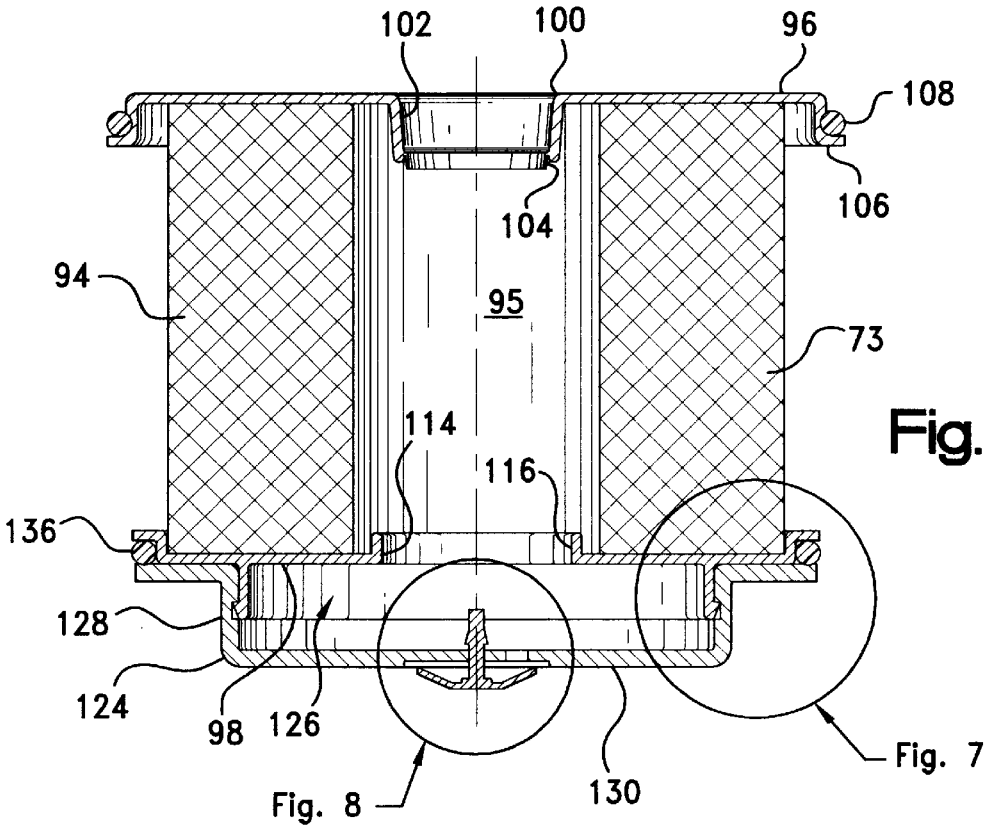
FIG. 6 is a cross-sectional side view of the filter element, taken substantially along the plane described by the lines 6—6 of FIG. 5.

The blow-by gasses with any remaining suspended oil then passes radially inward through crankcase filter 73. Referring now to FIGS. 5 and 6, the crankcase filter 73 comprises a replaceable filter element having a ring of filter media 94 circumscribing a central cavity 95. The ring of filter media can be formed from any material appropriate for the particular application. First and second impermeable end caps 96, 98 are provided at opposite end of the media, and are bonded thereto with an appropriate adhesive or potting compound. First (upper) end cap 96 has an annular configuration defining a central opening 100. Opening 100 is slightly larger than cylinder 63 (FIG. 3) of cover 62 such that the cylinder can be received in this opening. The upper end cap 96 includes a cylinder 102 outwardly bounding and extending inwardly from opening 100 into central cavity 95. Cylinder 102 of upper end cap 96 surrounds cylinder 63 of cover 62, and includes a resilient, annular, radially-inward directed seal 104 at its inner distal end which provides a fluid seal between the cover 62 and the first end cap 96 (see, e.g., FIG. 3). While seal 104 is illustrated as being unitary with cylinder 102, it is also possible that this seal could be a separate seal (such as an O-ring), supported within a channel or groove formed in cylinder 102 )or on cylinder 63 of cover 62).

The first end cap 96 also has a short cylindrical skirt with a radially-outward directed annular flange 106 around the periphery of the end cap. A resilient annular seal or O-ring 108 is carried by this skirt and flange, and provides a fluid seal between the sidewall 60, cover 62 and the first end cap 96 (see. e.g., FIG. 3). Sidewall 60 can have an inner annular shoulder 110 (FIG. 3) that closely receives the distal end of flange 106 to orient and support the filter element in the housing.

Figure 7:
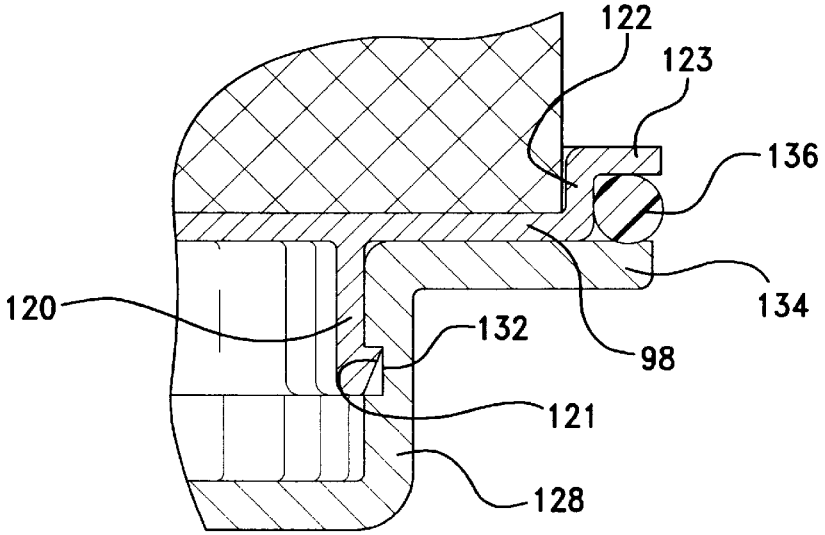
FIG. 7 is an enlarged cross-sectional side view of one portion of the filter element of FIG. 6.

The second end cap 98 also has an annular configuration defining a central opening 114. A short cylinder 116 outwardly bounds and extends inwardly from opening 114 into central cavity 95. As shown also in FIG. 7, a short cylinder 120 also extends downwardly away from the second end cap at a location toward the periphery of the end cap. Cylinder 120 includes an annular, radially-outward projecting catch or barb 121 around the outer circumference of the cylinder, toward its lower distal end. A short cylindrical flange 122 projects upwardly around the periphery of second end cap 98, and a short annular flange 123 then projects radially outward from flange 122.

A cup-shaped valve pan 124 is fixed to the second end cap 98, and together with the second end cap, defines a sump container integral with the filter element, that is, separate from the housing enclosing the element. The sump container includes an inner sump chamber, indicated generally at 126. Valve pan 124 has a cylindrical sidewall 128 and an integral (and preferably unitary) end wall 130. Cylindrical sidewall 128 closely receives the cylinder portion 120 of second end cap 98, and includes an inwardly-directed, circumferentially-extending channel 132 which receives catch 122 on cylinder portion 120. Catch 121 and channel 132 enable the valve pan 124 to be easily assembled with second end cap 98 in a permanent relation thereto. While catch 121 and channel 132 provide one means for fixing valve pan 124 to second end cap 98, sidewall 128 of valve pan 124 can alternatively be fixed to second end cap 98 by other appropriate means, such as with an adhesive or by sonic welding; or could even be formed unitarily (in one piece) with second end cap 98.

Valve pan 124 further includes a radially-outward projecting flange 134 at the upper end of the valve pan, which extends in surface-to-surface flush relation to second end cap 98, radially outward from cylinder 120. When the valve pan 124 is fixed to the second end cap 98, flanges 122 and 123 on second end cap 98, and flange 134 on valve pan 124, define an annular groove. A resilient annular seal or O-ring 136 is located in this groove in outwardly-bounding relation to the sump container, and provides a fluid seal between valve pan 124, second end cap 98 and sidewall 60 (see, e.g., FIG. 3). The second end cap 98 can also be radially smaller than illustrated such that the flange 134 of valve pan 124 is located in surrounding relation to the second end cap and in direct supporting relation with media ring 94. In this case, media 94 can be adhesively attached to second end cap 98 as well as flange 134 of valve pan 124, and seal 136 would be carried only by valve pan 124.

When filter element 73 is located in the housing, seals 108 and 136 fluidly seal against sidewall 60 on opposite sides of opening 92. A peripheral chamber 137 is thereby defined between the crankcase filter 73 and the sidewall 60 of the housing. Gasses passing through pressure control assembly 70 must thereby enter the peripheral chamber 137 and pass radially inward through media 94, without bypassing the element. Any oil remaining in the gasses is separated by the media 94, and collects on the inside surface of the media in central cavity 95. The oil then drips down into the area between the filter media 94 and the cylinder 116 of the lower end cap 98, as illustrated in FIG. 4. The oil eventually collects above the level of the cylinder, at which point it then drips downwardly into the sump chamber 126 and is contained by the valve pan.

Figure 9:
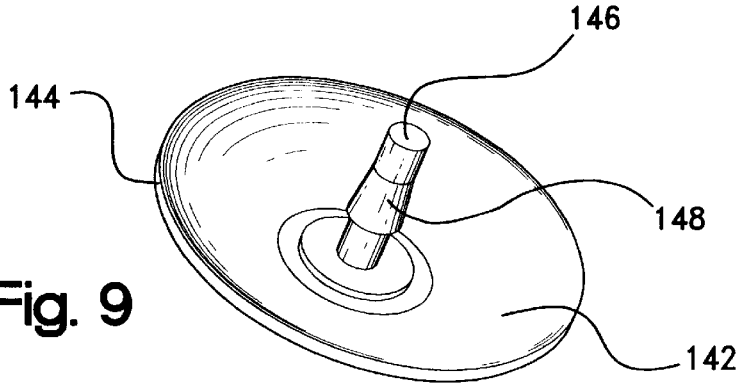
FIG. 9 is an elevated perspective view of the check valve element for the check valve of the filter element.
Figure 8:
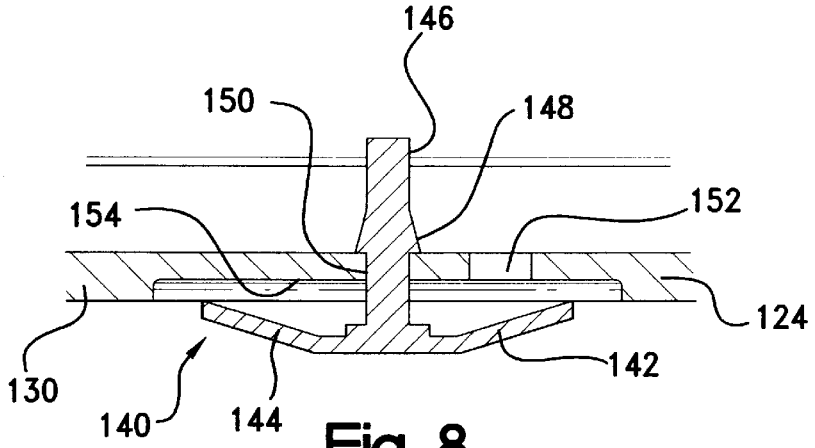
FIG. 8 is an enlarged cross-sectional side view of another portion of the filter element of FIG. 6.

The sump container further includes an integral, one-way check valve, indicated generally at 140 in FIG. 8, which prevents blow-by gasses from directly entering sump chamber 126 without passing through filter assembly 71, but which allows collected oil to drain out from the sump chamber 126 and return to the engine. To this end, referring now to FIGS. 8 and 9, the check valve includes a T-shaped resilient valve member 142 which includes a slightly concave circular head portion 144 and an integral cylindrical post or base portion 146. Post 146 includes a radially-outward projecting barb or shoulder 148, along the length of the post. Valve member 142 is preferably formed in one piece from an appropriate material.

The cylindrical post 146 of the valve member is slidingly received within a circular hole 150 formed centrally in the bottom wall 130 of the valve pan 124, with the valve head 144 located exterior to the valve pan 124. The post 146 has a dimension such that it can be forced through the hole with barb 148 also compressing and passing through hole 150, but the outwardly-projecting barb 148 prevents the valve element from being thereafter removed from the hole. As shown in FIG. 5, a series of flow or drain openings 152 are formed in an annular configuration in the bottom wall 130 of the valve pan. Flow openings 152 fluidly connect sump chamber 126 with central opening 93 in breather filter 72, and hence with gas inlet 20. When the valve member is in the position shown in FIGS. 4 and 8, that is, an open position, oil collected in the sump chamber 126 can pass through the flow openings 152, around the valve head 144 of the valve member 142, into central opening 93 in breather filter 72, and then to the gas inlet. Barb 148 on post 146 allows the valve member to slide into the position shown in these Figures, but prevents the valve member from entirely falling out of or being removed from the hole 150. The oil then drains back to the engine drain pan through the gas inlet 20. While four such flow openings 152 are shown, this is merely for illustration purposes, and the number and dimension of the flow openings will depend upon the particular application, as should be appreciated.

When the valve member 142 is in the position shown in FIG. 3, that is a closed position, the valve head 144 is pressed against the outer surface of the valve pan 124, and blocks the flow through flow openings 152. A slight recess 154 can be provided on the outer surface of the valve pan surrounding the flow openings 152 to facilitate a fluid-tight seal. The pressure of the blow-by gasses received in gas inlet 20 is typically greater than the pressure of the oil collected in the sump chamber 126, and the valve member is therefore generally maintained in a closed position during engine operation. However, during engine idle, or non-operation, pressure received through gas inlet 20 drops, and any oil collected in the sump chamber 126 flows through openings 152 and forces the valve head to the open position. The check valve thereby acts to prevent blow-by gasses from directly entering the sump chamber 126 (and thereby by-passing the filter assembly and possibly harming the engine) during engine operation, but allows collected oil to drain back to the engine to maintain an appropriate oil level in the engine.

The check valve 140, being a part of the filter element, is removed and replaced when the element is removed and replaced. This maintains a fresh check valve in the emission control system, and thus reduces the likelihood that the check valve needs to be independently inspected and replaced. Obviously the sump container is likewise removed with the filter element when the filter element is removed and replaced.

During operation of the engine 12 (FIG. 1), the engine air intake 34 or the turbo air intake 42 (FIG. 2) of a turbo-charged engine, which is connected to the gas outlet 22, creates a vacuum in the central cavity 95 of the crankcase filter 73. The pressure control assembly 70 keeps the pressure in the gas inlet 20 and engine crankcase constant. In addition, as indicated above, the breather filter initially separates larger oil droplets, while oil in the blow-by gasses also coats the valve plug 76. In either case, the oil drains down, and is returned to the engine.

Because oil is removed in the breather filter 72 as well as in the pressure control assembly 70, a fine filter media capable of filtering very fine particulates is not needed for the crankcase filter 73. Instead, efficient filtering is obtained using a coarser filter media with less pressure drop. The coarser filter is less expensive than fine filters, clogs less often, and requires less pressure drop for effective filtration. Thus, cost is reduced and maintenance intervals to replace the filter are increased. In addition, a large pressure drop for proper filtration is no longer required.

Particulate and oil-free crankcase emissions leave the filter media 73 and exit from the gas outlet 22. The cleaned crankcase emissions are then provided to the engine air intake 34 (FIG. 1) or the turbo air intake 42 (FIG. 2) for combustion.

The filter assembly of the present invention thereby overcomes many of the drawbacks of prior systems. Oil collected in the filter drains directly into a sump chamber (not through the filter media), and can be returned through a check valve to the engine. The oil drains back through the crankcase emissions line, which reduces the number of lines needed to and from the engine. The check valve is also integral with the filter element, and is thereby replaced at the same time the filter element is replaced. The replacement of the unique filter element can also be controlled, which ensures that only filter elements meeting the proper standards of quality and performance are used in the assembly. The filter assembly is used in a emissions control assembly to provide a system that is compact and combines various components into a single integrated unit, is efficient, and is simple and inexpensive to manufacture.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A replaceable filter element for a crankcase emission control assembly, the replaceable filter element comprising:

a ring of filter media circumscribing a central cavity and having a first end and a second end;

a first annular end cap sealingly attached to the first end of the filter media ring, said first-end cap having a central opening into the central cavity of the filter media ring;

a second annular end cap sealingly attached to the second end of the filter media ring, said second end cap also having a central opening into the central cavity of the filter media ring, said second end cap further including a cylindrical portion toward the periphery of the second end cap extending away from the filter media ring, and an annular, radially-outward directed catch on the cylindrical portion; and a cup-shaped valve pan having a cylindrical sidewall and an end wall, the cylindrical sidewall of the valve pan including an inwardly-directed, circumferentially-extending channel receiving the annular catch of the second end cap to fix the valve pan to the second end cap and define a sump chamber between the valve pan and second end cap in fluid communication with the central cavity of the filter media ring; and a check valve in the valve pan having at least one flow opening and a movable valve member, wherein the valve member can move to a first position, blocking flow through the at least one flow opening, and a second position, allowing flow through the at least one flow opening.

2. The replaceable filter element as in claim 1, wherein the valve pan includes an annular, radially-outward directed flange around a distal end of the cylindrical portion of the valve pan, and the second end cap includes a corresponding annular, radially-outward directed flange, the radially-outward directed flange of the valve pan disposed in surface-to-surface engagement with the radially-outward directed flange of the second end cap.

3. The replaceable filter element as in claim 2, wherein the radially-outward directed flange of the valve pan and the radially-outward directed flange of the second end cap define a radially-outward directed circumferential groove, and a resilient annular seal is disposed in the groove.

4. The replaceable filter element as in claim 3, wherein the first end cap includes a cylindrical shoulder outwardly bounding the end cap, and a second resilient annular seal is carried by the shoulder.

5. The replaceable filter element as in claim 4, wherein the first end cap includes a cylindrical portion bounding the central opening and extending inwardly into the central cavity, and a resilient seal is provided at the inner distal end of the cylindrical portion.

6. The replaceable filter element as in claim 1, wherein the valve member has a T-shaped configuration, a cylindrical post of the valve member being received for relative axial movement in a hole in the end wall of the valve pan proximate the at least one opening, and a head of the valve member being located exterior to the sump chamber, the head of the valve member is moved into blocking relation to the at least one opening when the valve member is in the first position, and into a non-blocking relation to the at least one opening when the valve member is in the second position.

7. The replaceable filter element as in claim 6, wherein the cylindrical post of the valve member includes an annular, radially-outward projecting shoulder along the length of the post, the shoulder limiting axial movement of the valve member in the hole of the end wall.

8. A replaceable filter element for a crankcase emission control assembly, the replaceable filter element comprising:

a ring of filter media circumscribing a central cavity and having a first end and a second end;

a first end cap sealingly attached to the first end of the filter media ring, said first end cap having a central opening into the central cavity of the filter media ring;

a sump container having an end cap portion sealingly attached to the second end of the filter media ring, said end cap portion having a central opening into the central cavity of the filter media ring, said sump container further including a valve pan, which together with the end cap portion defines a sump container between the valve pan and second end cap in fluid communication with the central cavity of the filter media ring; and a check valve in the valve pan having at least one flow opening and a movable valve member, wherein the valve member can move to a first position, blocking flow through the at least one flow opening, and a second position, allowing flow through the at least one flow opening, and wherein the sump container, ring of filter media and first end cap can be removed as an integral unit from the crankcase emission control assembly.

9. The replaceable element as in claim 8, wherein the end cap portion of the sump container includes an annular flange outwardly bounding the sump container, and a first resilient annular seal is carried by the annular flange of the end cap portion of the sump container.

10. The replaceable filter element as in claim 9, wherein the first end cap includes a cylindrical shoulder outwardly bounding the end cap, and a second resilient annular seal is carried by the shoulder of the first end cap.

11. The replaceable filter element as in claim 10, wherein the valve pan includes an annular, radially-outward directed flange around a distal free end of a cylindrical portion of the valve pan, and the end cap portion of the sump container includes a corresponding annular, radially-outward directed flange, the radially-outward directed flange of the valve pan disposed in surface-to-surface engagement with the radially-outward directed flange of the second end cap.

12. The replaceable filter element as in claim 11 wherein the radially-outward directed flange of the valve pan and the radially-outward directed flange of the end cap portion of the sump container define a radially-outward directed circumferential groove, and the first resilient seal is disposed in the groove.

13. The replaceable filter element as in claim 8, wherein the valve member has a T-shaped configuration, a cylindrical post of the valve member being received in a hole in the end wall of the valve pan proximate the at least one opening and moveable therein, and a head of the valve member being located exterior to the sump container, wherein the head of the valve member is moved into blocking relation to the at least one opening when the valve member is in the first position, and into a non-blocking relation to the at least one opening when the valve member is in the second position.

14. The replaceable filter element as in claim 13, wherein the cylindrical post of the valve member includes an annular, radially-outward projecting shoulder along the length of the post, the shoulder limiting axial movement of the valve member in the hole of the end wall.

15. The replaceable filter element as in claim 8, wherein the valve pan is a separate component from the end cap portion of the sump container, and is fixed to the end cap portion with fixing means.

16. A replaceable filter element removably positionable in a housing for a crankcase emission control assembly, the replaceable filter element comprising:

a ring of filter media circumscribing a central cavity and having a first end and a second end;

a first annular end cap sealingly attached to the first end of the filter media ring, said first end cap having a central opening into the central cavity of the filter media ring;

a sump container integral with the second end of the filter media ring and independent from the housing of the crankcase emission control assembly, said sump container having i) a sump chamber in fluid communication with the central cavity of the filter media ring for collecting liquid, and ii) a check valve having a drain opening and moveable valve member, the valve member moveable between a first position blocking liquid flow through the drain opening in the sump container, and a second position allowing collected liquid to flow outwardly from the sump container through the drain opening in the sump container.

17. The replaceable filter element as in claim 16, wherein the sump container, ring of filter media and first annular end cap can be removed as an integral unit from the housing.

18. The replaceable filter element as in claim 17, further including a first annular seal bounding the periphery of the first end cap for sealing with one portion of the housing, and a second annular seal bounding the periphery of the sump container for sealing with another portion of the housing.

19. The replaceable filter element as in claim 18, wherein the check valve member is operably moved into the first position by fluid pressure external to the sump container, and operably moved into the second position by liquid pressure in the sump container.

20. The replaceable filter element as in claim 19, wherein the valve member has a T-shaped configuration, a cylindrical post of the valve member being moveably received in a hole in the sump container proximate the drain opening, and a head of the valve member being located exterior of the sump container, wherein the head of the valve member is moved into blocking relation to the drain opening when the valve member is in the first position, and into a non-blocking relation to the drain opening when the valve member is in the second position.

21. The replaceable filter element as in claim 20, wherein the cylindrical post of the valve member includes an annular, radially-outward projecting shoulder along the length of the post, the shoulder limiting movement of the valve member in the hole of the sump container.

22. The replaceable filter element as in claim 16, wherein the sump container includes an end cap portion fluidly sealed to the second end of the filter media ring, and a cup-shaped portion which together with the end cap portion defines the sump chamber.

23. The replaceable filter element as in claim 22, wherein the valve member of the check valve is carried by the cup-shaped portion of the sump container.

24. The replaceable filter element as in claim 16, wherein the check valve is a one-way check valve, allowing liquid to flow only outwardly from the sump container, away from the filter element.

25. A filter assembly for a crankcase emission control assembly, the filter assembly comprising a housing having a first port receiving blow-by gasses from an engine crankcase, a filter subassembly in the housing removing suspended oil in the gasses, and a second port directing substantially oil-free gasses to the engine introduction system, the filter subassembly including a filter element having i) an integral sump container collecting the oil when the oil is separated from the gasses, and ii) a check valve operable to normally prevent blow-by gasses received in the first port from directly entering the sump container, and allow the collected oil in the sump container to drain through a drain opening in the filter subassembly when the fluid pressure of the collected oil in the sump container is greater than the gas pressure of the blow-by gasses in the first port.

26. The filter assembly as in claim 25, wherein the filter element is removably received in the housing and the filter subassembly further includes a primary breather filter fixed in the housing.

27. The filter assembly as in claim 25, wherein the housing includes a cylindrical sidewall removably receiving the filter element, and a removable cover allowing removal and replacement of the filter element from the sidewall.

28. The filter assembly as in claim 25, wherein the filter element includes:

a ring of filter media circumscribing a central cavity and having a first end and a second end;

a first annular end cap sealingly attached to the first end of the filter media ring, said first end cap having a central opening into the central cavity of the filter media ring;

the sump container sealingly attached to the second end of the filter media ring and independent from the housing of the crankcase emission control assembly, said sump container having i) a sump cavity in fluid communication with the central cavity of the filter media ring for collecting liquid, and ii) the check valve member moveable between a first position blocking liquid flow through the drain opening in the sump container, and a second position allowing collected liquid to flow outwardly from the sump cavity through the drain opening in the sump container.

29. The filter assembly as in claim 28, wherein the sump container can be removed from the housing, as an integral unit with the ring of filter media and the first end cap.

30. The filter assembly as in claim 28, further including a first annular resilient seal carried around the periphery of the first end cap for sealing with one portion of the housing, and a second annular resilient seal carried around the periphery of the sump container for sealing with another portion of the housing.

31. The filter assembly as in claim 28, wherein the valve member has a T-shaped configuration, a cylindrical post of the valve member being received for relative axial movement in a hole in the sump container proximate the drain opening, and a head of the valve member being located exterior to the sump container, wherein the head of the valve member is moved into blocking relation to the drain opening when the valve member is in the first position, and into a non-blocking relation to the drain opening when the valve member is in the second position.

32. The filter assembly as in claim 31, wherein the cylindrical post of the valve member includes an annular, radially-outward projecting shoulder along the length of the post, the shoulder limiting axial movement of the valve member in the hole of the sump container.

33. The filter assembly as in claim 28, wherein the sump container includes an end cap portion fluidly sealed to the second end of the filter media ring, and a cup-shaped container portion which together with the end cap portion define the sump chamber.

34. The filter assembly as in claim 33, wherein the valve member is carried by the cup-shaped container portion of the sump container.

35. The filter assembly as in claim 28, wherein the check valve is a one-way check valve, allowing liquid to flow only outwardly from the sump container, away from the filter element.

36. The filter assembly as in claim 26, wherein the housing includes a cylindrical sidewall and a bottom wall, with the first port being provided centrally in the bottom wall, and the breather filter comprises an annular media member disposed against the bottom wall of the housing with a central opening in surrounding relation to the first port, the blow-by gasses entering the first port passing radially-outward through the breather filter to the filter element, wherein the breather filter separates at least some of the suspended oil from the blow-by gasses entering the first port and the separated oil can then drain back through the first port to the engine crankcase.

37. The filter assembly as in claim 36, wherein the replaceable filter element is positioned in the housing such that the sump container is toward the bottom of the filter element and adjacent the breather filter, and the check valve directs oil into the central opening of the breather filter and to the first port when the valve member is in the second position.

38. The filter assembly as in claim 37, further including a peripheral chamber surrounding the filter element, wherein the blow-by gasses passing through the breather filter pass into the peripheral chamber and then flow radially inward through the filter element where substantially the remainder of the suspended oil is separated from the blow-by gasses, the oil collecting in the sump chamber and being returned to the engine crankcase when the pressure of the collected oil in the sump chamber is greater than the pressure of the blow-by gasses in the first port.

39. An internal combustion engine, comprising:

an engine block with an inlet and an outlet;

an induction system communicating with the inlet to the engine block; and a filter assembly, the filter assembly comprising a housing having a first port receiving blow-by gasses from the outlet of the engine block, a filter subassembly in the housing removing suspended oil in the gasses, and a second port directing substantially oil-free gasses to the induction system and then to the inlet of the engine block for combustion, the filter subassembly including a filter element with an integral sump container collecting the oil when the oil is separated from the gasses, and a check valve operable to normally prevent blow-by gasses received in the first port from directly entering the sump container, and allow the collected oil in the sump container to drain through a drain opening in the filter subassembly and back to the engine block through the first port when the fluid pressure of the collected oil in the sump container is greater than the gas pressure of the blow-by gasses in the first port.

* * * * *